United States Patent [19]

Dykast et al.

[11] 4,329,839

[45] May 18, 1982

[54] METHOD OF AND APPARATUS FOR STARTING AN OPEN-END SPINNING MACHINE

[75] Inventors: Jaroslav Dykast, Usti nad Orlici; Karel Mikulecky, Chocen; Miloslav Tyl, Usti nad Orlici, all of Czechoslovakia

[73] Assignee: Vyzkumny ustav bavlnarsky, Usti nad Orlici, Czechoslovakia

[21] Appl. No.: 139,807

[22] Filed: Apr. 14, 1980

[51] Int. Cl.[3] ..... D01H 15/00; D01H 1/30

[52] U.S. Cl. ..... 57/263

[58] Field of Search ..... 57/78, 80, 81, 261, 57/263, 353

[56] References Cited

U.S. PATENT DOCUMENTS

| | | | |
|---|---|---|---|
| 3,541,774 | 11/1970 | Sterba et al. | 57/81 X |
| 3,601,969 | 8/1971 | Susami et al. | 57/80 X |
| 4,020,622 | 5/1977 | Lattion | 57/80 X |
| 4,156,341 | 5/1979 | Raasch | 57/263 |
| 4,163,359 | 8/1979 | Honjo | 57/263 X |

*Primary Examiner*—Donald Watkins

[57] ABSTRACT

Method of and apparatus for operating an open end spinning machine having a plurality of spinning units each including a sliver feeding device, a fiber separating device, a twist forming element, a yarn taking-off device, yarn winding device and a reversing mechanism for returning the yarn end back into the twist forming element. The twist forming element and the fiber separating device are set in operation; thereafter the fiber feeding is started simultaneously with the yarn end reverse travel to return same into the twist forming element in which a fibrous ribbon is formed of the fibers supplied. After spinning-in said yarn end with said fibrous ribbon the yarn is again set into a forward operative travel.

5 Claims, 4 Drawing Figures

METHOD OF AND APPARATUS FOR STARTING AN OPEN-END SPINNING MACHINE

The present invention relates to a method and apparatus for starting an open-end spinning machine comprising several spinning units in which a twisted yarn is formed by some unconventional principle of spinning.

In known open-end spinning machines, individual yarn breakages occur during their operation, and when the machines are stopped, breaking of the yarn simultaneously takes place in all their spinning units. In such case, it is necessary to introduce the broken-off yarn ends back to respective twist forming elements where they come into contact with fed fibers and, after being spun-in, the spun yarns are transported forwardly and wound onto bobbins.

In British Pat. No. 1,084,662, the problem of starting a spinning machine is solved by an electrically controlled apparatus wherein in a predetermined time period the spinning means is first started, then the spun yarn end is transported back into said spinning means, afterwards fibers are fed into said spinning means so that the previously spun yarn end is connected with those fibers, whereupon after the spinning-in the spun yarn is transported forwardly and is wound onto a bobbin. This system has the disadvantage of the necessity of controlling many switches and time relays for the starting and stopping of reversible coupling means, the feeding of fibers, and the delivery of spun yarns. Further complications are connected with the setting of predetermined time periods for such operation, such periods being related to the count of spun yarns.

A similar solution of the problem having similar disadvantage is disclosed in British Pat. No. 1,192,377, which is to a certain degree analogous to British Pat. No. 1,084,662, the only difference being in the feeding of the fibers, which in the latter case precedes the transport of the yarn end back into the spinning means.

Another method of starting an open-end spinning machine is disclosed in Czechoslovak Pat. No. 116,998, wherein the yarn is spun-in by means of an ejector and a traversably arranged yarn guide. After the start of the spinning rotor the yarn end is blown into it by the said ejector. When the yarn end comes into contact with the ribbon of fibers in the rotor, the tension of the newly spun yarn will displace a yarn breakage detector into its spinning position, whereby both the feeding of fibers and the take-off of the newly spun yarn are switched on. This method has, however, the disadvantage of weak piecing of the yarn, since the feeding of fibers into spinning rotor is started too late i.e. at the moment when the yarn has simultaneously been taken-off from the spinning rotor.

A similar principle of starting an open end spinning machine is disclosed in British Pat. No. 1,359,754 for semi-automatic spinning-in, wherein the yarn end is introduced into a yarn delivery tube and a yarn reserve in the form of a loop is formed on a so-called spinning-in lever. By tilting this lever down, the wound bobbin and the upper delivery roller are tilted into operative position whereby the said yarn reserve is simultaneously released. Also in this case, when the yarn end comes into contact with the ribbon of fibers, the tension of the newly spun yarn displaces a yarn breakage detector into its operative position whereby the feeding of fibers will be started before detector switches on the electromagnetic yarn feeding clutch are actuated.

These known methods of starting a spinning operation are also disclosed in German Application DE-OS No. 23 13 788 wherein a spinning-in program is described according to which the spinning machine at its being started operation at a lower speed compared with its normal speed. Also in this case it is necessary to employ a complicated system of time delay means for the program of starting, spinning, and stopping the machine.

The same methods are also practiced by an apparatus disclosed in British Pat. No. 1,419,440 wherein the feeding of fibers is started either before or after the start of the reverse movement of the yarn end into the spinning rotor by means of delivery and winding rollers. The reverse and forward movement of these rollers is controlled by a contactless sensor.

Similar solutions are also disclosed in British Pat. No. 1,458,435 wherein the moment of starting the feed of fibers before the reverse movement of delivery and winding rollers is determined in a relatively complicated way by means of time relays and measuring devices.

From the point of view of practical usage in a spinning mill, all the above systems have the disadvantage of a relatively complicated controlling apparatus which may cause complications in adjusting the switching means necessary for a successful spinning-in of the yarn end in the spinning unit. Moreover, with respect to those machines in which for an automatic spinning-in operation the reverse movement of delivery and winding rollers is used, serious problems are encountered especially with regard to high delivery speed of spun yarns, such increased high delivery speed also corresponding to the same increased high reverse speed of the delivery and winding rollers. It has been found that in such cases there is such a critical moment of inertia of the said delivery and winding rollers that mechanically it is impossible under the present state of things to spin-in a yarn which is spun at a high delivery speed.

It is an object of the present invention to overcome the said complications and problems, and only to simplify the method of and apparatus for starting an open-end spinning machine, but also to make the spinning-in process possible even at high delivery speeds.

According to the present invention there is provided a method of starting the spinning operation comprising the steps of automatically resuming the feeding of fibers simultaneously with the start of the feeding of the yarn end back into the twist forming element.

Another object of the invention is to feed the yarn end back into the twist forming element at a reverse speed which is different from the forward delivery speed, the difference between such speed depending upon the count of the spun yarn.

Another object of the invention is to provide an arrangement of the yarn end at a predetermined distance from the twist forming element in dependence upon the count of spun yarn; such object may be also combined i.e. with the different reverse speed at which the yarn end is fed to the twist forming element.

A preferred method according to the invention comprises a series of simplified steps for starting the spinning operation, including the step of starting the twist forming elements (e.g. spinning rotors of a multiple spinning unit machine), the step of starting the fiber separating elements (e.g. combing rollers), and the step of simultaneously starting the feed of fibers on one side and the feeding of the end of yarn on the other side, whereby the reverse speed of the said yarn end is lower than the forward speed of the newly spun yarn.

According to the present invention there is provided open end spinning apparatus consisting of a plurality of spinning units each comprising means for forming twist, fiber feeding means, fiber separating means, yarn take-off means, and yarn winding means, which means are controlled by a control apparatus for starting said twist forming means and fiber separating means, whereby the said control apparatus and the apparatus for open end spinning preferably includes means for simultaneously resuming the feeding of fibers with the reversal of the yarn take-off and yarn winding means, so that the yarn end is fed back into the twist forming means to be connected there with fed fibers, thus effecting an automatic piecing, and means for automatically again reversing the said yarn take-off and yarn winding means for the normal delivery of yarn from the said twist forming means.

Another apparatus according to the present invention preferably includes, apart from the twist forming means, fiber separating means, and yarn take-off and yarn winding means as well as yarn reserve forming means, which means are controlled by a control apparatus for starting said twist forming means and fiber separating means. Afterwards the control apparatus simultaneously actuate the fiber feeding means for resuming the feeding of fibers to the said fiber separating means and the yarn reserve means for releasing the end of yarn to be fed back to the twist forming means at a predetermined reverse speed, the normal delivery of yarn from the said twist forming means being resumed by the yarn take-off and yarn winding means.

By the use of the said difference in speed or distance, a sufficient time interval is gained for forming a fibrous ribbon in the twist forming element before the returned yarn end has contacted that ribbon. After the yarn end and the ribbon have been spun-in in this way, the normal yarn take-off is restarted. The instant of restarting can be determined by a known time-delay or metering device, or quite simply by the effect of the tension of spun-in yarn upon the yarn breakage detector. Any of these devices may give the necessary impulse for restarting the yarn take-off.

Such method of simplified starting of the spinning operation brings about a simplification of both the control apparatus and the steps involved in the adjustment and maintenance of the machine, so that in case of an automatic or semi-automatic spinning-in process it is necessary only to determine the speed of the yarn end return and/or the distance at which the yarn end is to be spaced from the twist forming element.

An important advantage of the invention is that the spinning-in process is effected at lowered reverse speeds of both the take-off and the winding devices in comparison with normal or operative take-off speed. In this way, there is achieved not only a considerable improvement in the quality of the yarn and its spun-in joint strength, as well as a higher reliability of the spinning-in process, but there is also eliminated a considerable stress imposed upon both the reversing and the operative motion clutches; such stresses occur particularly at relatively high take-off and reverse speeds when both the take-off and the winding devices abruptly change their direction of rotation, i.e. from a high reverse speed to the same high operative take-off speed. In such cases, there occur not only pronounced slippage of the reversing clutches, but also the slippage of the wound bobbins which results in many simultaneous thread breakages.

The invention will be more fully understood upon consideration of the accompanying drawings, in which.

Figure 1:
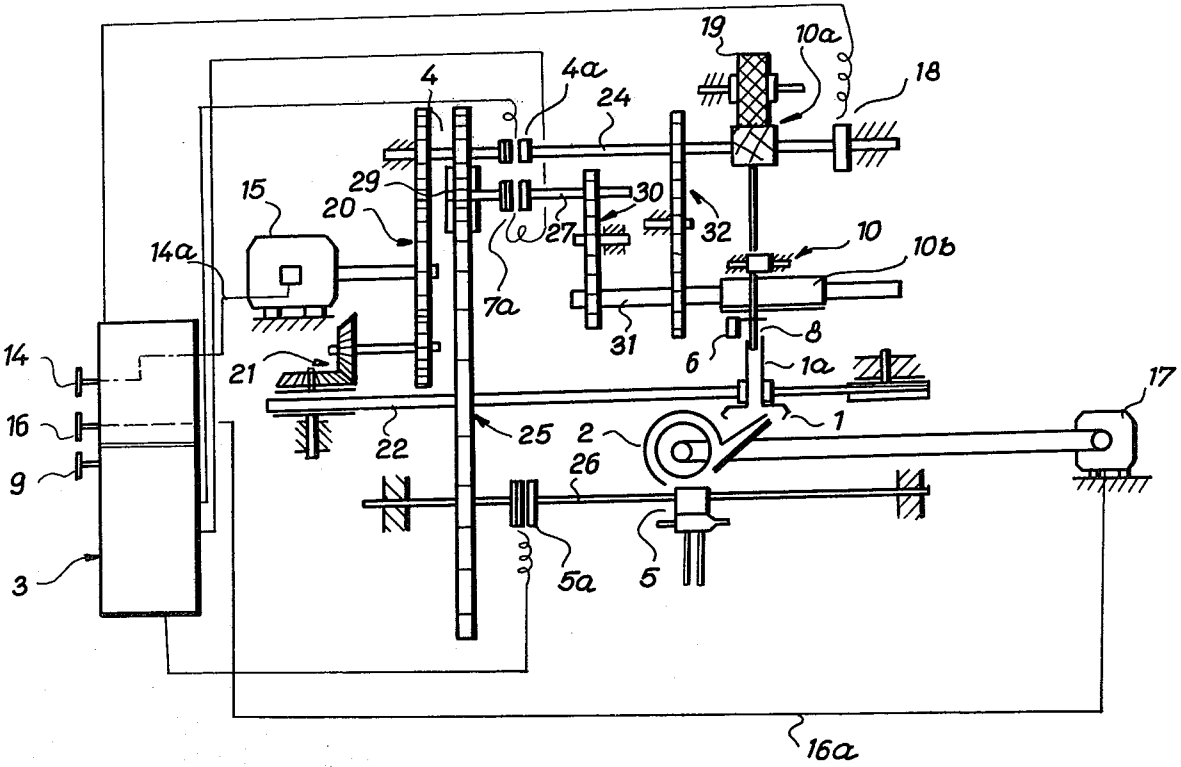
FIG. 1 is a schematic view of a first embodiment of apparatus in accordance with the invention for controlling an open-end spinning unit.

Turning first to FIG. 1, there is schematically shown a first embodiment of apparatus in accordance with the invention for controlling an open-end spinning unit. Such apparatus includes a rotatably driven twisting element 1 having a take-off tube 1*a* coaxial with the axis of rotation of the twisting element. The twisting element is supplied with sliver by a feeding device 5 from which the fiber material is forwarded to a combing roller 2 on its way to the twisting element 1. The twisting element 1, the combing roller 2, and other elements appurtenant thereto are under the control of a control device 3, to be described in detail hereinafter. Yarn 8 emerging from the upper end of the tube 1*a* is engaged by the feeler of a breakage detecting sensor 6 in its passage to the yarn taking-off device 10 and a yarn winding device 10*a* which winds the yarn upon a bobbin as shown at 19.

The twisting or twist forming element 1, the yarn taking-off device 10, and the yarn winding device 10*a* are driven by a motor 15. The combing roller or fiber separating device 2 is driven by a motor 17 as by means of a belt 22, as shown. It is to be understood that in FIG. 1 only one twisting unit is shown; in practice, a single motor 15 may be employed to drive the above recited parts of a plurality of twisting units, and that a motor 17 may be employed to drive the fiber separating devices of a plurality of twisting units.

The motor 15 is shown drivingly connected to a first gear train 20 which drives a shaft 24 in a forward, yarn take-up, direction when an electromagnetic clutch 4*a* interposed in shaft 24 is engaged by being energized. When shaft 24 is thus driven, it also drives a shaft 31 and the take-up roller 10*b* affixed thereto through a second gear train 32. A selectively driven reverse shaft 27 having an electromagnetic clutch 7*a* interposed therein is drivingly connected to a third gear train 25 intermediate thereof; the driven end of gear train 25 is constantly driven from the constantly driven portion of the shaft 24. When the clutch 7*a* is closed or energized and the clutch 4*a* is open or de-energized, the gear train 25 drives the shaft 27 and a third gear train 30 connected thereto, and gear train 30 drives the shaft 31, to which it is connected, and the yarn take-off device 10 in reverse direction, and through the second gear train 32 also drives the yarn winding device 10*a* in the reverse direction. It is to be understood that the difference in speed of the yarn return motion relative to normal take-off speed, may be changed by substituting gears having different effective diameters in the gear trains which drive the various elements in their forward and reverse directions.

The motor 15, acting through the first gear train 20 and a bevel gear set 21 drives a belt 22 for rotating the twist forming element 1 of the twisting unit. Drivingly connected to the gear train 25 is a shaft 26 having an electromagnetic clutch 5*a* interposed therein. The sliver feeding device 5 is connected to shaft 26, as shown.

Motor 15 is electrically energized through conduit 14*a* upon pushing a push button 14 of the control unit 3. Motor 17 is energized through a conduit 16*a* upon the pushing of a button 16 of control unit 3. The entire twisting unit is prepared for operation upon the pushing of a main switch button 9.

Figure 2:
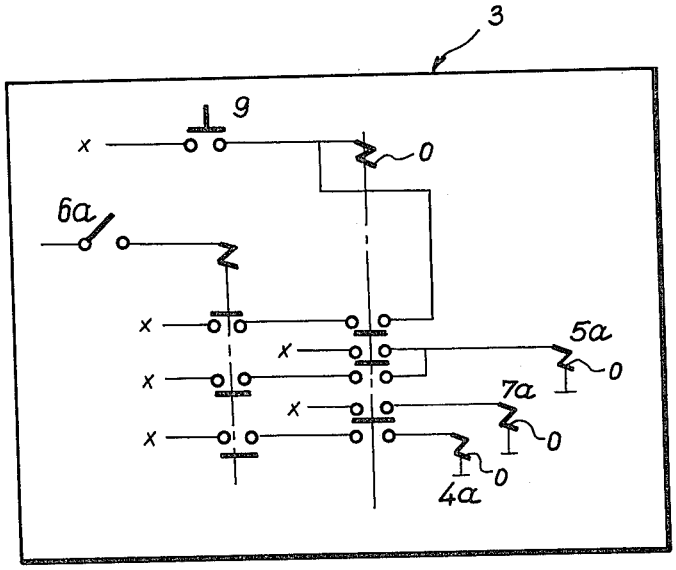
FIG. 2 is a wiring diagram of a control unit for the apparatus of FIG. 1.

FIG. 2 shows the wiring diagram of the control apparatus 3 provided with the push-button switch 9 for simultaneously switching on the sliver feeding device 5 and the reversing mechanism for controlling the yarn return motion. The function of the control element 9 as indicated above is replaced in this case by the function of the switch 6*a* of the yarn breakage detector 6. After the yarn 8 has been spun-in, the switch 6*a* (due to the respective action of the yarn breakage detector 6) will switch off the reverse motion clutch 7*a* and simultaneously switch on the clutch 4*a* for normal yarn take-off.

It will be assumed that in FIG. 1, a twist forming element 1 and a fiber separating device 2 have been set in operation by means of the push button 14 for starting the motor 15 and the push button 16 for starting the motor 17, the end of yarn 8 which, at this instant is received in a predetermined portion of the take-off tube 1*a*, is returned back to said element 1 at an appropriate reverse speed by means of the reversing mechanism via the clutch 7*a* while simultaneously the sliver feeding device 5 is switched on via the clutch 5*a*, all of this being in response to pushing down a single button 9 of a control apparatus 3 for controlling the spinning-in process.

Figure 3:
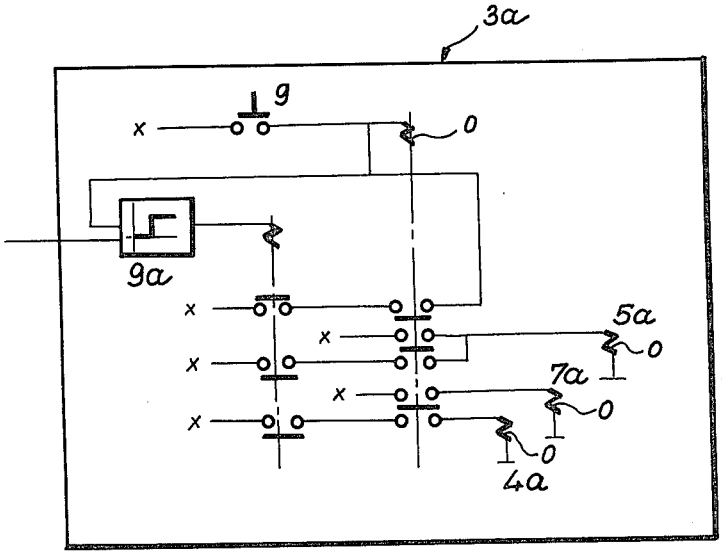
FIG. 3 is a wiring diagram of an alternative control unit for the apparatus of FIG. 1.

FIG. 3 shows an alternative wiring diagram 3*a* of the control apparatus provided with the push-button 9 for simultaneously switching on the sliver feeding device 5 and the reversing mechanism 7 for the yarn return motion as well as the control element 9*a* to switch off the reverse motion clutch 7*a* and at the same time to switch on a clutch 4*a* for normal yarn take-off.

After the spinning-in process has been finished, the control apparatus 3*a* emits another signal via a control element 9*a* (FIG. 3) to switch off the reverse motion clutch 7*a* and simultaneously to switch on a clutch 4*a* to start the normal yarn take-off.

The control element 9*a* shown in FIG. 3 may be a time relay or one of the well-known metering devices and will determine the instant of restarting the normal yarn take-off.

Figure 4:
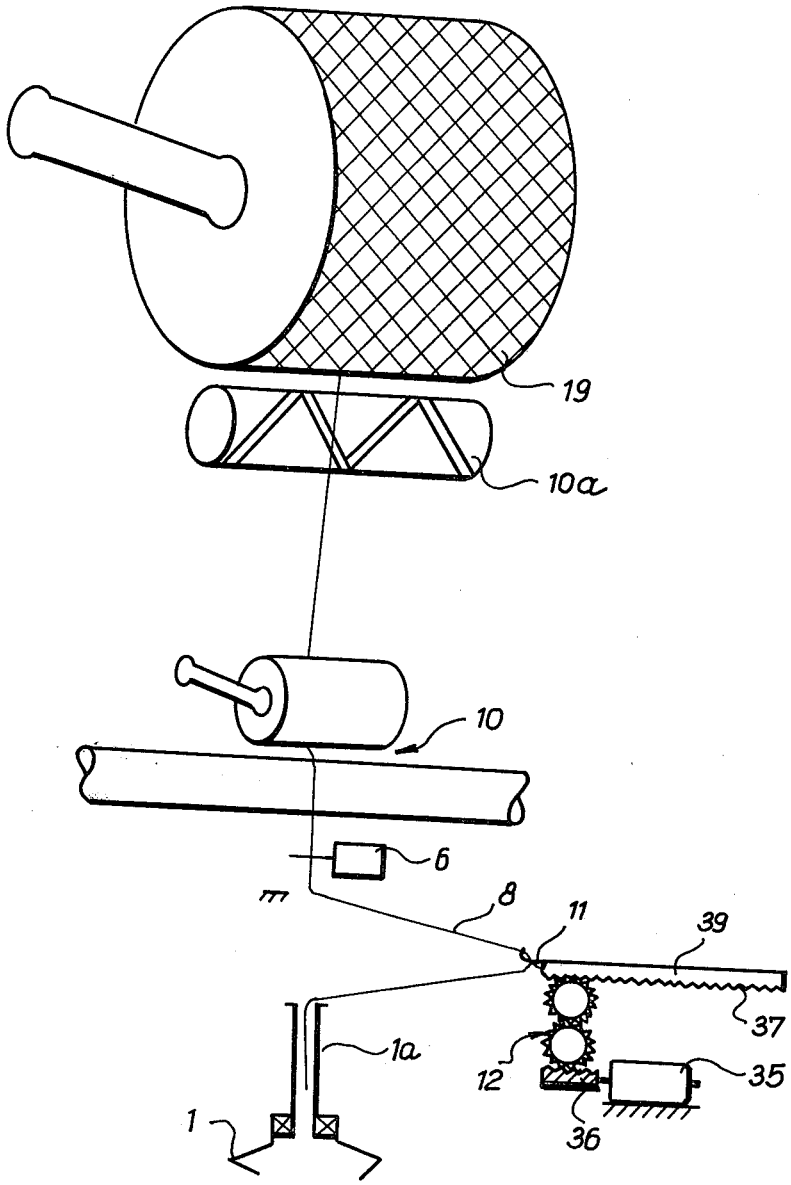
FIG. 4 is a fragmentary schematic view of a second embodiment of apparatus in accordance with the invention for controlling an open-end spinning unit.

An alternative embodiment of the invention is illustrated by FIG. 4 wherein the yarn return motion is derived from a yarn diverting guide 11 which has previously formed a yarn reverse between the take-off rollers 10 and the twist forming element 1. As shown, it is advantageous to keep the upper take-off roller 10 and the bobbin 19 in the raised position during the spinning-in operation. The difference in speed of the yarn return motion relative to normal take-off speed is taken care of by a change speed gear mechanism or another kind of variable speed mechanism 12.

In a similar way, it is possible also to apply the invention to a semi-automatic spinning-in process wherein the operator, after having cleaned and restarted the twist forming element and the fiber separating device 2, introduces the end of yarn 8 into the take-off tube 1*a* to a predetermined distance from said element 1 and by pushing down the button 9 gives a signal for reintroducing the yarn end into the element 1 while simultaneously the sliver feed is switched on. After the spinning-in process has been finished, a yarn tension causes the arm of the yarn breakage detector 6 to assume its operative position, whereby the signal for normal yarn take-off by this detector is automatically emitted.

It is to be understood that the above-described preferred embodiments of the invention are not intended to limit in any way the scope thereof and that other combinations or arrangements can be applied, provided they do not depart from the invention as defined in the appended claims.

We claim:

1. A method of starting a high-speed open-end spinning machine having a plurality of spinning units each including a fiber feeding device, a fiber separating device, a twist forming element, a yarn taking-off and winding device, and a yarn reversing mechanism for returning a yarn end back into the twist forming element, said method comprising setting said twist forming element and said fiber separating device in operation at normal spinning speed, thereafter starting the feeding of fibers by said fiber feeding device and returning the yarn end back by said yarn reversing mechanism at a lower speed than the normal take-up speed of yarn spun by the spinning machine, and thereafter taking-up yarn at said normal spinning speed by the machine and winding it by the winding device.

2. A method as claimed in claim 1, wherein prior to the start of the spinning-in operation, introducing the yarn end to a point spaced a predetermined distance from the twist forming element, which distance depending upon the desired count of spun yarn.

3. In a high-speed open-end spinning machine having a plurality of spinning units driven at a constant speed and each including a fiber feeding device, a fiber separating device, a twist forming element, a device for taking off yarn at a first, normal high speed, a yarn winding device, and a yarn reversing mechanism for returning a yarn end back into the twist forming element at a second speed which is lower than said first speed, the improvement comprising a gear mechanism in the reversing mechanism, said gear mechanism providing a speed of reverse yarn return which is substantially less than that of the forward operative yarn motion.

4. A high-speed open-end spinning machine according to claim 3, comprising at least one control apparatus having switches for starting the twist forming element and the fiber separating device, and a push-button switch for starting the reversing mechanism and the fiber feeding device in response to a single impulse.

5. An open-end spinning machine in accordance with claim 4, comprising a fiber feed clutch, a reversing clutch, and an operative motion clutch, and wherein the control apparatus comprises switches for starting the twist forming element and the fiber separating device, regulating means for switching-on the fiber feed clutch and the reversing clutch in response to a first impulse, means for switching off said reversing clutch and switching on the operative motion clutch in response to a second impulse, and means for connecting the push-button switch with the regulating means.

* * * * *